US008171941B2

(12) United States Patent
Carter et al.

(10) Patent No.: US 8,171,941 B2
(45) Date of Patent: May 8, 2012

(54) CIGARETTE CUSTOMIZATION APPARATUS AND ASSOCIATED METHOD

(75) Inventors: Brent Walker Carter, High Point, NC (US); John Larkin Nelson, Lewisville, NC (US); Rebecca Anne Rogers, Pinnacle, NC (US)

(73) Assignee: R. J. Reynolds Tobacco Company, Winston Salem, NC (US)

( * ) Notice: Subject to any disclaimer, the term of this patent is extended or adjusted under 35 U.S.C. 154(b) by 621 days.

(21) Appl. No.: 11/678,672

(22) Filed: Feb. 26, 2007

(65) Prior Publication Data

US 2008/0202540 A1 Aug. 28, 2008

(51) Int. Cl.
*A24D 3/04* (2006.01)

(52) U.S. Cl. ..... 131/284; 131/336

(58) Field of Classification Search ..... 131/249, 131/336

See application file for complete search history.

(56) References Cited

U.S. PATENT DOCUMENTS

| | | | |
|---|---|---|---|
| 3,288,147 | A | 11/1966 | Molins et al. |
| 3,308,600 | A | 3/1967 | Erdmann et al. |
| 3,424,172 | A | 1/1969 | Neurath et al. |
| 3,596,663 | A | 8/1971 | Schultz et al. |
| 3,915,176 | A | 10/1975 | Heitmann et al. |
| 3,972,335 | A | 8/1976 | Tiggelbeck et al. |
| 4,082,098 | A | 4/1978 | Owens, Jr. |
| 4,174,719 | A | 11/1979 | Martin et al. |
| 4,280,187 | A | 7/1981 | Reuland et al. |
| 4,281,670 | A | 8/1981 | Heitmann et al. |
| 4,281,671 | A | 8/1981 | Bynre et al. |
| 4,291,713 | A | 9/1981 | Frank |
| 4,474,190 | A | 10/1984 | Brand |
| 4,508,525 | A | 4/1985 | Berger |
| 4,574,816 | A | 3/1986 | Rudszinat |
| 4,643,205 | A | 2/1987 | Redding et al. |
| 4,646,763 | A | 3/1987 | Nichols |
| 4,655,736 | A | 4/1987 | Keith |
| 4,677,995 | A | 7/1987 | Kallianos et al. |
| 4,715,390 | A | 12/1987 | Nichols et al. |
| 4,726,385 | A | 2/1988 | Chumney, Jr. |
| 4,729,391 | A | 3/1988 | Woods et al. |
| 4,736,754 | A | 4/1988 | Heitmann et al. |
| 4,768,526 | A | 9/1988 | Pryor |
| 4,781,203 | A | 11/1988 | La Hue |
| 4,807,809 | A | 2/1989 | Pryor et al. |
| 4,811,745 | A | 3/1989 | Cohen et al. |
| 4,850,301 | A | 7/1989 | Greene, Jr. et al. |
| 4,862,905 | A | 9/1989 | Green, Jr. et al. |

(Continued)

FOREIGN PATENT DOCUMENTS

DE 10 2004 031 185 A1 1/2006

(Continued)

*Primary Examiner* — Philip Tucker
*Assistant Examiner* — Vicki Wu
(74) *Attorney, Agent, or Firm* — Womble Carlyle Sandridge & Rice LLP

(57) ABSTRACT

An apparatus for customizing an as-formed cigarette is provided, wherein the as-formed cigarette has a cylindrical rod configuration defining a longitudinal axis, and includes a filter rod portion and a contiguous tobacco rod portion. Such an apparatus comprises a feeder unit configured to feed an as-formed cigarette, from a plurality of as-formed cigarettes, to a register position. An imprinting unit is configured to interact with the as-formed cigarette in the register position so as to imprint at least one of an alphanumeric character and a graphical character thereon. An associated method is also provided.

12 Claims, 7 Drawing Sheets

U.S. PATENT DOCUMENTS 4,878,506 A 11/1989 Pinck et al.
4,920,990 A 5/1990 Lawrence et al.
4,925,602 A 5/1990 Hill et al.
4,941,486 A 7/1990 Dube et al.
5,012,823 A 5/1991 Keritsis et al.
5,012,829 A 5/1991 Thesing et al.
5,025,814 A 6/1991 Raker
5,060,664 A 10/1991 Siems et al.
5,060,665 A 10/1991 Heitmann
5,074,320 A 12/1991 Jones, Jr. et al.
5,101,839 A 4/1992 Jakob et al.
5,105,838 A 4/1992 White et al.
5,156,169 A 10/1992 Holmes et al.
5,159,944 A 11/1992 Arzonico et al.
5,191,906 A 3/1993 Myracle, Jr.
5,220,930 A 6/1993 Gentry
5,225,277 A 7/1993 Takegawa et al.
5,271,419 A 12/1993 Arzonico et al.
5,360,023 A 11/1994 Blakley et al.
5,387,285 A 2/1995 Rivers
5,396,909 A 3/1995 Gentry et al.
5,510,616 A * 4/1996 Seymour et al. ..... 850/63
5,718,250 A 2/1998 Banerjee et al.
6,180,914 B1 * 1/2001 Jones et al. ..... 219/121.68
6,229,115 B1 5/2001 Voss et al.
6,272,654 B1 8/2001 Freiburger
6,360,751 B1 3/2002 Fagg et al.
6,537,186 B1 3/2003 Veluz
6,647,878 B2 11/2003 Blau et al.
6,779,530 B2 8/2004 Kraker
6,848,449 B2 2/2005 Kitao et al.
6,904,917 B2 6/2005 Kitao et al.
7,074,170 B2 7/2006 Lanier, Jr. et al.
2002/0020420 A1 2/2002 Xue et al.
2002/0166563 A1 11/2002 Jupe et al.
2003/0136419 A1 7/2003 Muller
2003/0145866 A1 8/2003 Hartmann
2004/0129281 A1 7/2004 Hancock et al.
2004/0261807 A1 12/2004 Dube et al.
2005/0000527 A1 * 1/2005 Dombek et al. ..... 131/284
2005/0016556 A1 1/2005 Ashcraft et al.
2005/0039764 A1 2/2005 Barnes et al.
2005/0066981 A1 3/2005 Crooks et al.
2005/0066986 A1 3/2005 Nestor et al.
2005/0076929 A1 4/2005 Fitzgerald et al.
2005/0103355 A1 5/2005 Holmes
2005/0194014 A1 9/2005 Read, Jr.
2006/0169295 A1 8/2006 Draghetti
2006/0272654 A1 12/2006 Barnes et al.
2006/0272655 A1 12/2006 Thomas et al.
2007/0006888 A1 1/2007 Hicks et al.
2007/0056600 A1 3/2007 Coleman et al.

FOREIGN PATENT DOCUMENTS

DE 102004031185 A1 * 1/2006
EP 1 585 089 A1 10/2005
GB 2 199 726 A 7/1988
WO WO 03/009711 A1 2/2003
WO WO 03/047836 A1 6/2003
WO WO 2006/016154 A2 2/2006
WO WO 2006/064371 A1 6/2006

* cited by examiner

CIGARETTE CUSTOMIZATION APPARATUS AND ASSOCIATED METHOD

BACKGROUND OF THE INVENTION

1. Field of the Invention

Aspects of the present invention are directed to smoking articles such as cigarettes and, more particularly, to an apparatus and associated method for customizing as-formed cigarettes.

2. Description of Related Art

Popular smoking articles, such as cigarettes, have a substantially cylindrical rod shaped structure and include a charge, roll, or column of smokable material such as shredded tobacco (e.g., in cut filler form) surrounded by a paper wrapper thereby forming a so-called "smokable rod" or "tobacco rod." Normally, a cigarette has a cylindrical filter element aligned in an end-to-end relationship with the tobacco rod. Typically, a filter element comprises cellulose acetate tow plasticized using triacetin, and the tow is circumscribed by a paper material known as "plug wrap." A cigarette can incorporate a filter element having multiple segments, and one of those segments can comprise activated charcoal particles. See, for example, U.S. Pat. No. 6,537,186 to Veluz; PCT Publication No. WO 2006/064371 to Baneijea; and U.S. patent application Ser. No. 11/226,932, filed Sep. 14, 2005, to Coleman III, et al.; each of which is incorporated herein by reference. Typically, the filter element is attached to one end of the tobacco rod using a circumscribing wrapping material known as "tipping paper," in order to provide a so-called "filtered cigarette." It also has become desirable to perforate the tipping material and plug wrap, in order to provide dilution of drawn mainstream smoke with ambient air. Descriptions of cigarettes and the various components thereof are set forth *Tobacco Production, Chemistry and Technology*, Davis et al. (Eds.) (1999). A cigarette is employed by a smoker by lighting one end thereof and burning the tobacco rod. The smoker then receives mainstream smoke into his/her mouth by drawing on the opposite end (e.g., the filter or mouth end) of the cigarette.

Various attempts to alter the visual attributes of cigarettes have been proposed. For example, there have been attempts to alter the color of the wrapping materials that provide the wrapping material of the tobacco rod (e.g., cigarettes marketed under the trade name "More" by R. J. Reynolds Tobacco Company possess cigarette rod wrapping papers exhibiting a brown color) and tipping materials used to attach the tobacco rod to the filter element (e.g., tipping materials have been printed or otherwise formed so as to possess a "cork" appearance and/or to possess at least one circumscribing ring). In addition, there have been attempts to alter the general appearance of the filter elements of cigarettes. See, for example, the types of cigarette filter element formats, configurations and designs set forth in U.S. Pat. No. 3,596,663 to Schultz; U.S. Pat. No. 4,508,525 to Berger; U.S. Pat. No. 4,646,763 to Nichols; U.S. Pat. No. 4,655,736 to Keith; U.S. Pat. No. 4,726,385 to Chumney, Jr.; U.S. Pat. No. 4,807,809 to Pryor et al.; and U.S. Pat. No. 5,025,814 to Raker; and U.S. patent application Ser. No. 11/377,630, filed Mar. 16, 2006, to Crooks et al.; each of which is incorporated herein by reference.

The sensory attributes of cigarette smoke can be enhanced by applying additives to tobacco and/or by otherwise incorporating flavoring materials into various components of a cigarette. See, Leffingwell et al., *Tobacco Flavoring for Smoking Products*, R. J. Reynolds Tobacco Company (1972). For example, one type of tobacco flavoring additive is menthol. See, Borschke, *Rec. Adv. Tob. Sci.*, 19, p. 47-70, 1993. Various proposed methods for modifying the sensory attributes of cigarettes have involved suggestion that filter elements may be used as vehicles for adding flavor to the mainstream smoke of those cigarettes. U.S. Patent Application Publication No. 2002/0166563 to Jupe et al. proposes the placement of adsorbent and flavor-releasing materials in a cigarette filter. U.S. Patent Application Publication No. 2002/0020420 to Xue et al. proposes the placement of fibers containing small particle size adsorbents/absorbents in the filter. U.S. Pat. No. 4,941,486 to Dube et al. and U.S. Pat. No. 4,862,905 to Green, Jr. et al. propose manners and methods for the placement of a flavor-containing pellet in each cigarette filter. Other representative types of cigarette filters incorporating flavoring agents are set forth in U.S. Pat. No. 3,972,335 to Tiggelbeck et al.; U.S. Pat. No. 4,082,098 to Owens, Jr.; U.S. Pat. No. 4,281,671 to Byrne; U.S. Pat. No. 4,643,205 to Redding et al.; U.S. Pat. No. 4,677,995 to Kallianos et al.; U.S. Pat. No. 4,715,390 to Nichols et al.; U.S. Pat. No. 4,729,391 to Woods et al.; U.S. Pat. No. 4,768,526 to Pryor; U.S. Pat. No. 5,012,829 to Thesing et al.; U.S. Pat. No. 5,387,285 to Rivers; and U.S. Pat. No. 7,074,170 to Lanier, Jr. et al.; each of which is incorporated herein by reference. See, also, the types of cigarette filter technologies that are discussed in the background art section set forth in U.S. Patent Application Publication No. 2004/0261807 to Dube et al.; which is incorporated herein by reference.

In any instance, it would be highly desirable to provide a smoker with the ability to enhance his/her smoking experience, such as can be accomplished by providing a filtered cigarette possessing a filter element end having particular design features. That is, it would be desirable to provide a cigarette possessing filter end components that are employed in a manner such that the visual appearance of the cigarette is aesthetically pleasing and can be readily customized. It also would be desirable to provide a cigarette possessing selected design features that can be modified or otherwise controlled or customized in a selective manner. Thus, there exists a need for a system and method for selectively customizing cigarettes. Such a solution should desirably involve minimal equipment, should be relatively simple and cost effective; should be portable, if necessary, and otherwise should not require extensive set up and testing procedures; and should facilitate maintenance thereof, with ready access to the cigarettes being processed thereby.

BRIEF SUMMARY OF THE INVENTION

The above and other needs are met by aspects of the present invention which, in one instance, provides an apparatus for customizing an as-formed, wherein the as-formed cigarette has a cylindrical rod configuration defining a longitudinal axis, and includes a filter rod portion and a contiguous tobacco rod portion. Such an apparatus comprises a feeder unit configured to feed an as-formed cigarette, from a plurality of as-formed cigarettes, to a register position. An imprinting unit is configured to interact with the as-formed cigarette in the register position so as to selectively imprint at least one of an alphanumeric character and a graphical character thereon.

Another aspect of the present invention is directed to a method of customizing an as-formed cigarette, wherein the as-formed cigarette has a cylindrical rod configuration defining a longitudinal axis, and includes a filter rod portion and a contiguous tobacco rod portion. Such a method comprises feeding an as-formed cigarette, from a plurality of as-formed cigarettes, to a register position using a feeder unit. At least one of an alphanumeric character and a graphical character is then selectively imprinted on the as-formed cigarette, in the register position, using an imprinting unit.

Aspects of the present invention thus address the needs identified above and provide significant advantages as further discussed herein.

BRIEF DESCRIPTION OF THE SEVERAL VIEWS OF THE DRAWINGS

Figure 1:
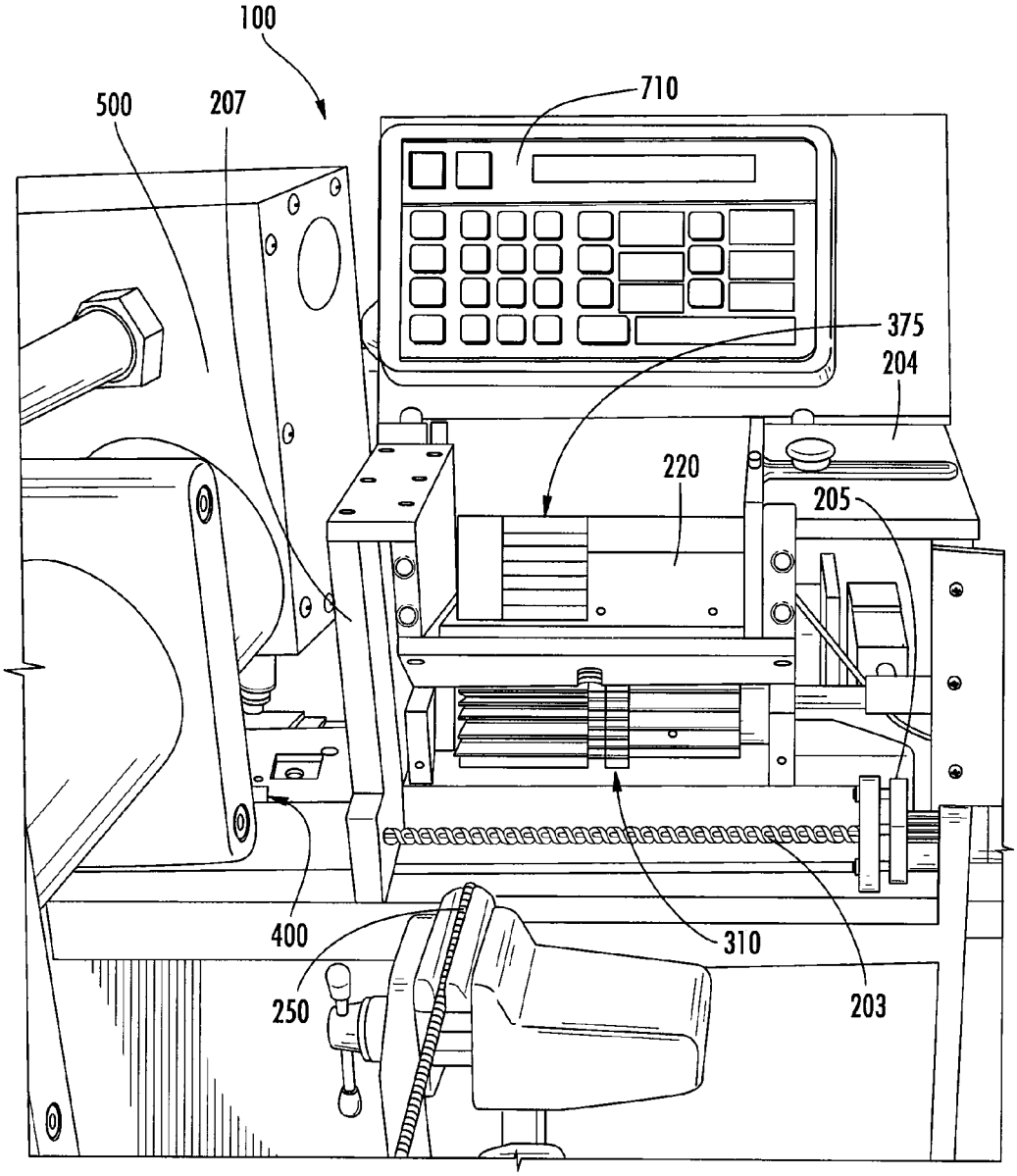
Figure 2:
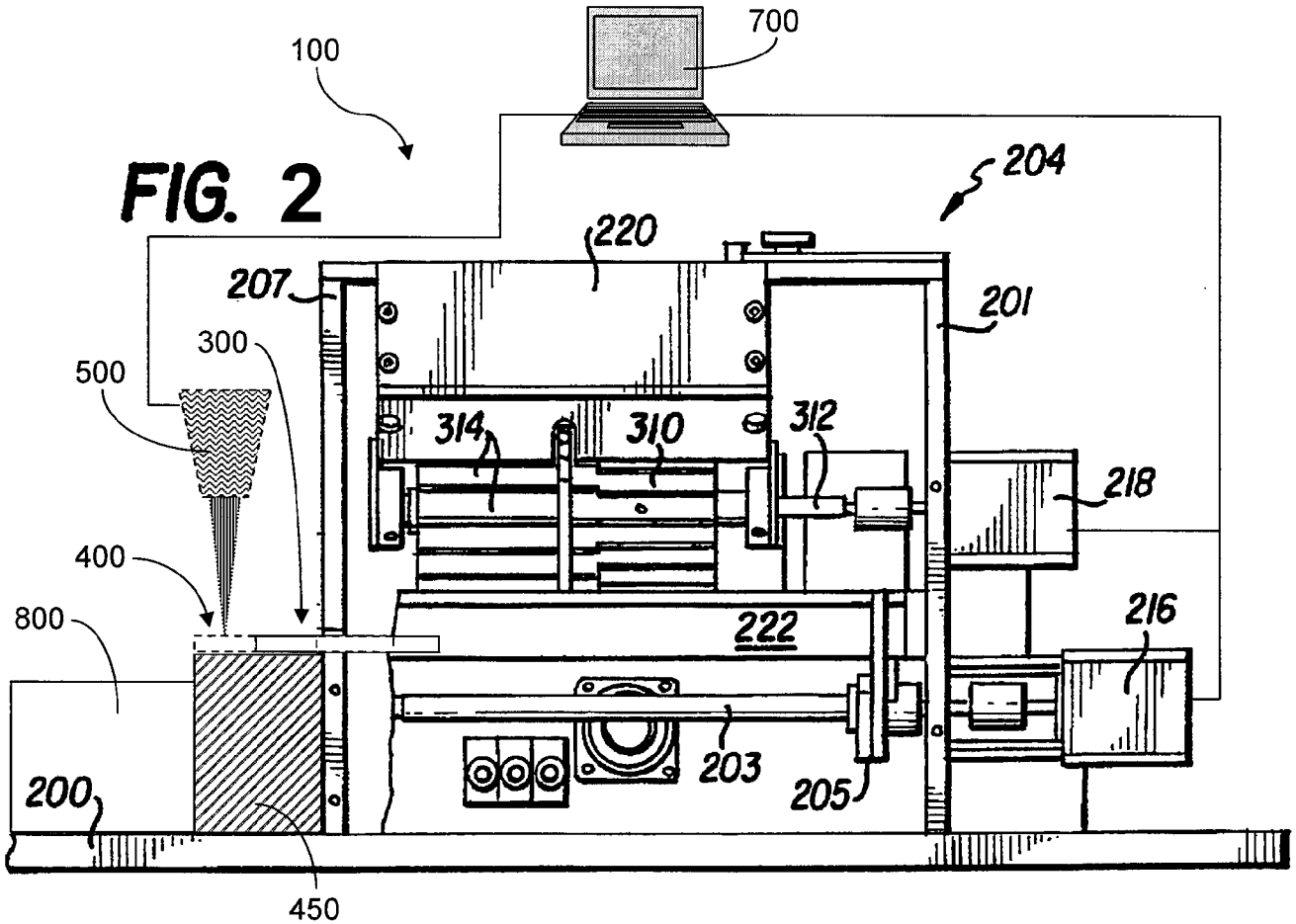
Figure 3A:
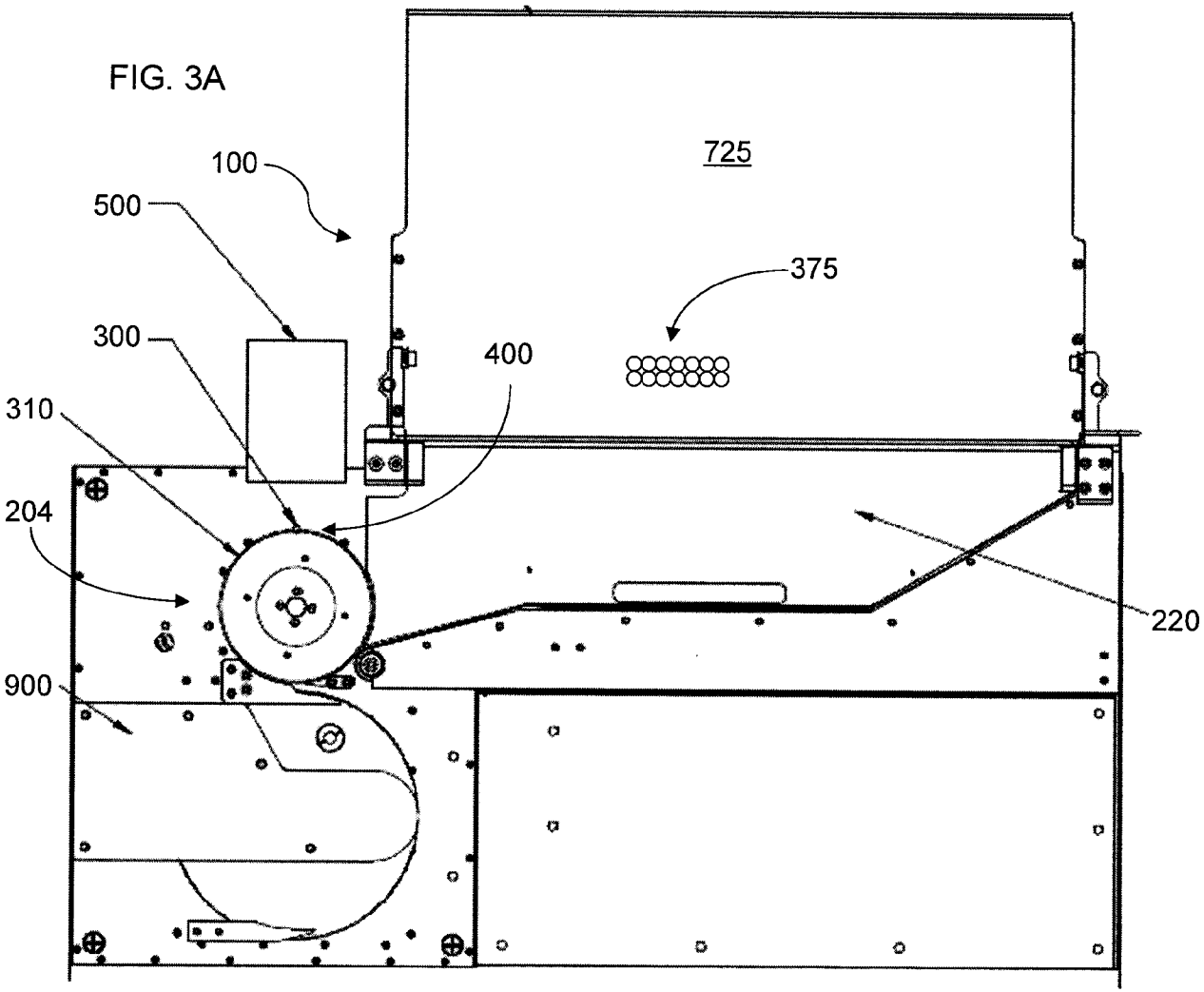
Figure 3B:
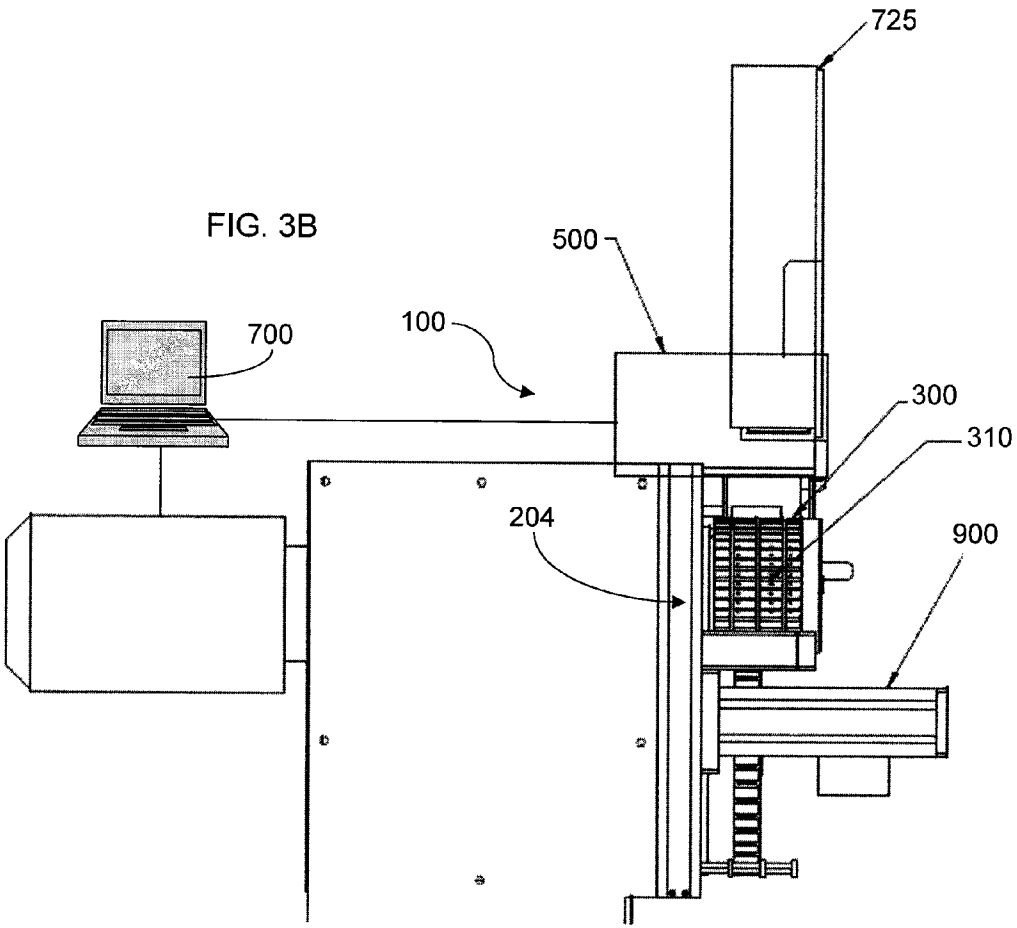
Figure 4:
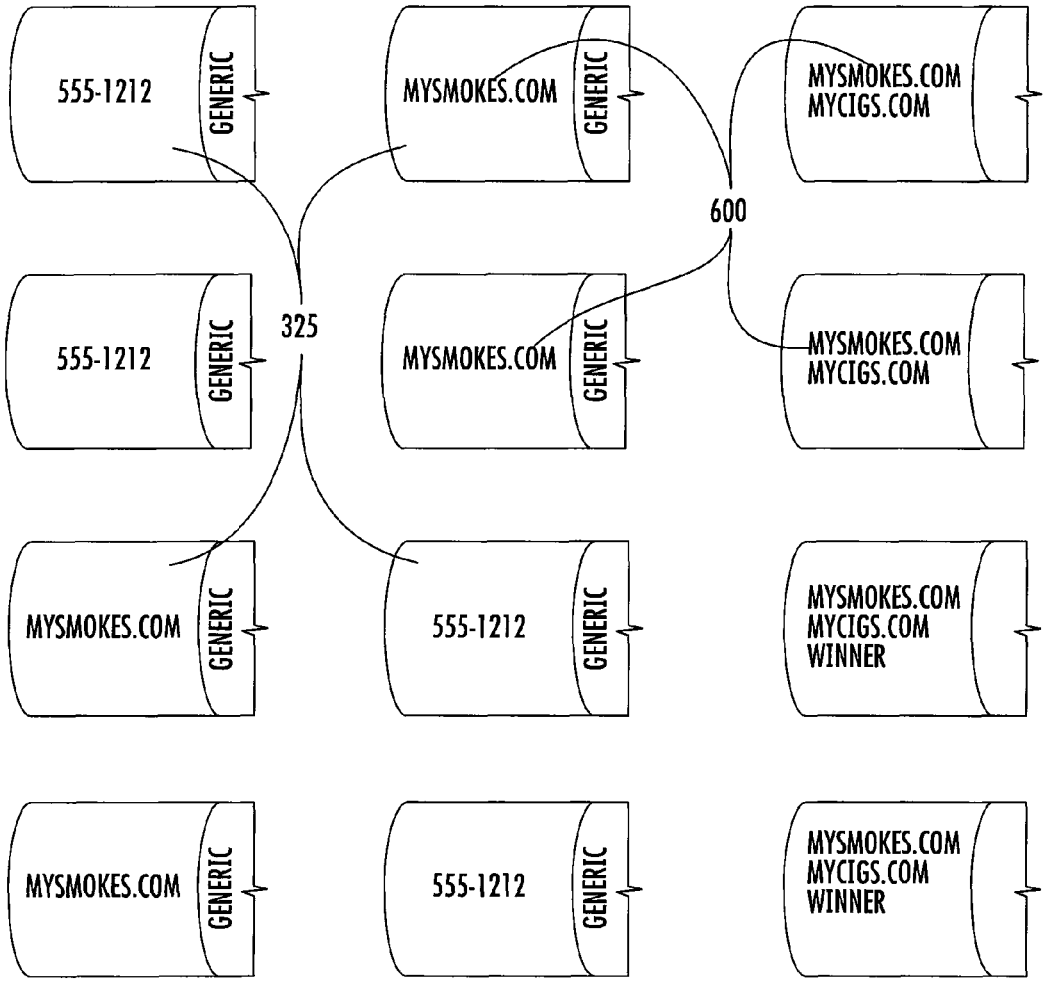
Figure 5:
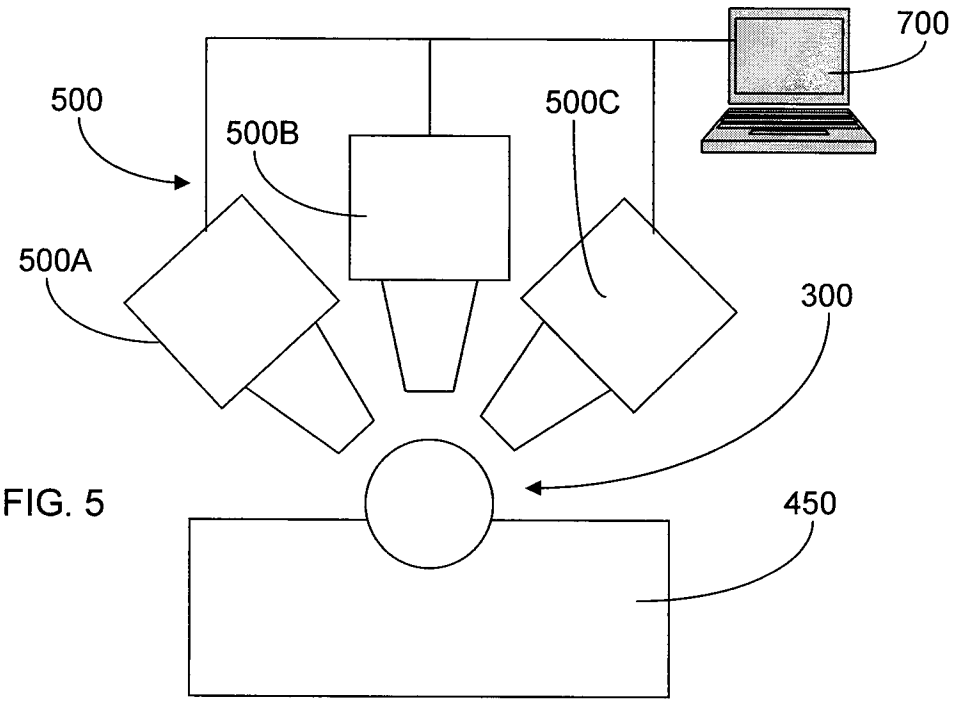
Figure 6:
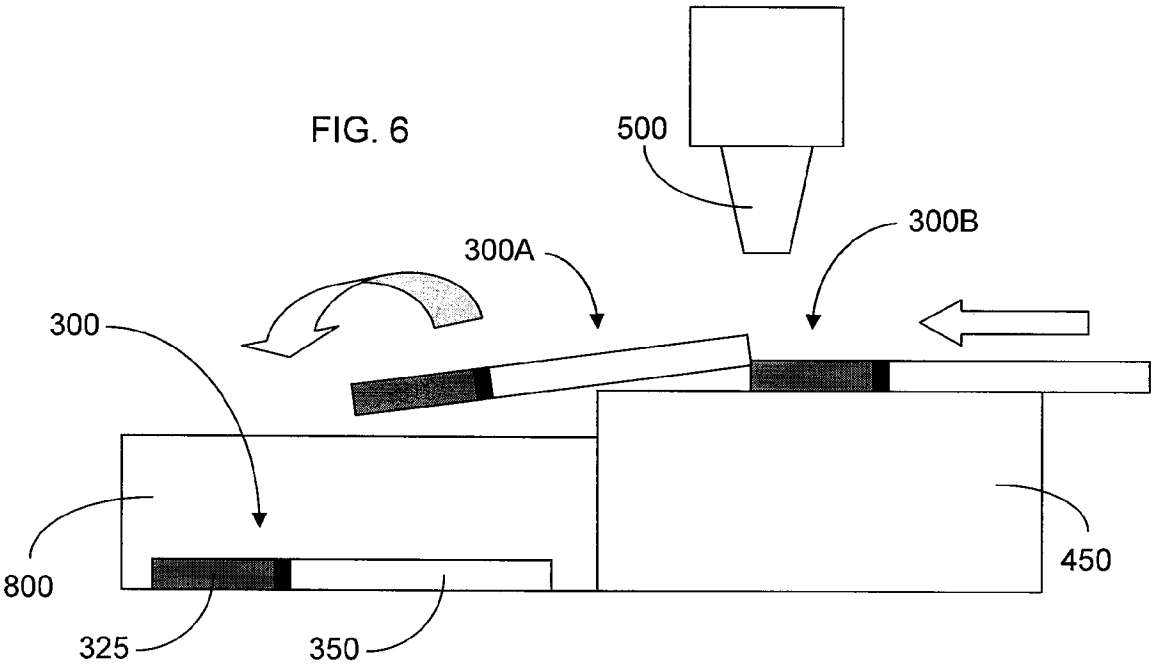

Having thus described the invention in general terms, reference will now be made to the accompanying drawings, which are not necessarily drawn to scale, and wherein:

FIGS. 1 and 2 are schematics of a cigarette customization apparatus, according to one aspect of the present invention;

FIGS. 3A and 3B are perpendicular views of a cigarette customization apparatus, according to an alternate aspect of the present invention;

FIG. 4 illustrates various examples of at least one of an alphanumeric character and a graphical character imprinted on a filter portion of a cigarette with a cigarette customization apparatus according to one aspect of the present invention;

FIG. 5 is a schematic of a cigarette customization apparatus according to an alternate aspect of the present invention, implementing a plurality of imprinting elements; and FIG. 6 is a schematic of cigarette customization apparatus according to one aspect of the present invention, implementing a successive feed system and method.

DETAILED DESCRIPTION OF THE INVENTION

The present invention now will be described more fully hereinafter with reference to the accompanying drawings, in which some, but not all aspects of the inventions are shown. Indeed, these inventions may be embodied in many different forms and should not be construed as limited to the aspects set forth herein; rather, these aspects are provided so that this disclosure will satisfy applicable legal requirements. Like numbers refer to like elements throughout.

Cigarette rods are manufactured using a cigarette making machine, such as a conventional automated cigarette rod making machine. Exemplary cigarette rod making machines are of the type commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. No. 4,781,203 to La Hue; U.S. Pat. No. 4,844,100 to Holznagel; U.S. Pat. No. 5,156,169 to Holmes et al.; U.S. Pat. No. 5,191,906 to Myracle, Jr. et al.; U.S. Pat. No. 6,647,870 to Blau et al.; U.S. Pat. No. 6,848,449 to Kitao et al.; and U.S. Pat. No. 6,904,917 to Kitao et al.; and U.S. Patent Application Publication Nos. 2003/0145866 to Hartman; 2004/0129281 to Hancock et al.; 2005/0039764 to Barnes et al.; and 2005/0076929 to Fitzgerald et al.; each of which is incorporated herein by reference.

The components and operation of conventional automated cigarette making machines will be readily apparent to those skilled in the art of cigarette making machinery design and operation. For example, descriptions of the components and operation of several types of chimneys, tobacco filler supply equipment, suction conveyor systems and garniture systems are set forth in U.S. Pat. No. 3,288,147 to Molins et al.; U.S. Pat. No. 3,915,176 to Heitmann et al; U.S. Pat. No. 4,291,713 to Frank; U.S. Pat. No. 4,574,816 to Rudszinat; U.S. Pat. No. 4,736,754 to Heitmann et al. U.S. Pat. No. 4,878,506 to Pinck et al.; U.S. Pat. No. 5,060,665 to Heitmann; U.S. Pat. No. 5,012,823 to Keritsis et al. and U.S. Pat. No. 6,360,751 to Fagg et al.; and U.S. Patent Application Publication No. 2003/0136419 to Muller; each of which is incorporated herein by reference. The automated cigarette making machines of the type set forth herein provide a formed continuous cigarette rod or smokable rod that can be subdivided into formed smokable rods of desired lengths.

Various types of cigarette components, including tobacco types, tobacco blends, top dressing and casing materials, blend packing densities and types of paper wrapping materials for tobacco rods, can be employed. See, for example, the various representative types of cigarette components, as well as the various cigarette designs, formats, configurations and characteristics, that are set forth in Johnson, Development of Cigarette Components to Meet Industry Needs, 52$^{nd}$ T.S.R.C. (September, 1998); U.S. Pat. No. 5,101,839 to Jakob et al.; U.S. Pat. No. 5,159,944 to Arzonico et al.; U.S. Pat. No. 5,220,930 to Gentry and U.S. Pat. No. 6,779,530 to Kraker; U.S. Patent Publication Nos. 2005/0016556 to Ashcraft et al. and 2005/0066986 to Nestor et al.; and U.S. patent application Ser. Nos. 11/375,700, filed Mar. 14, 2006, to Thomas et al. and Ser. No. 11/408,625, filed Apr. 21, 2006, to Oglesby; each of which is incorporated herein by reference. Most preferably, the entire smokable rod is composed of smokable material (e.g., tobacco cut filler) and a layer of circumscribing outer wrapping material.

Components for filter elements for filtered cigarettes typically are provided from filter rods that are produced using traditional types of rod-forming units, such as those available as KDF-2 and KDF-3E from Hauni-Werke Korber & Co. KG. Typically, filter material, such as filter tow, is provided using a tow processing unit. An exemplary tow processing unit has been commercially available as E-60 supplied by Arjay Equipment Corp., Winston-Salem, N.C. Other exemplary tow processing units have been commercially available as AF-2, AF-3, and AF-4 from Hauni-Werke Korber & Co. KG. In addition, representative manners and methods for operating a filter material supply units and filter-making units are set forth in U.S. Pat. No. 4,281,671 to Byrne; U.S. Pat. No. 4,862,905 to Green, Jr. et al.; U.S. Pat. No. 5,060,664 to Siems et al.; U.S. Pat. No. 5,387,285 to Rivers; and U.S. Pat. No. 7,074,170 to Lanier, Jr. et al. Other types of technologies for supplying filter materials to a filter rod-forming unit are set forth in U.S. Pat. No. 4,807,809 to Pryor et al. and U.S. Pat. No. 5,025,814 to Raker; which are incorporated herein by reference.

The filter material can vary, and can be any material of the type that can be employed for providing a tobacco smoke filter for cigarettes. Preferably a traditional cigarette filter material is used, such as cellulose acetate tow, gathered cellulose acetate web, polypropylene tow, gathered cellulose acetate web, gathered paper, strands of reconstituted tobacco, or the like. Especially preferred is filamentary tow such as cellulose acetate, polyolefins such as polypropylene, or the like. One filter material that can provide a suitable filter rod is cellulose acetate tow having 3 denier per filament and 40,000 total denier. As another example, cellulose acetate tow having 3 denier per filament and 35,000 total denier can provide a suitable filter rod. As another example, cellulose acetate tow having 8 denier per filament and 40,000 total denier can provide a suitable filter rod. For further examples, see the types of filter materials set forth in U.S. Pat. No. 3,424,172 to Neurath; U.S. Pat. No. 4,811,745 to Cohen et al.; U.S. Pat. No. 4,925,602 to Hill et al.; U.S. Pat. No. 5,225,277 to Takegawa et al. and U.S. Pat. No. 5,271,419 to Arzonico et al.; each of which is incorporated herein by reference.

Normally a plasticizer such as triacetin is applied to the filamentary tow in traditional amounts using known techniques. Other suitable materials or additives used in connection with the construction of the filter element will be readily apparent to those skilled in the art of cigarette filter design and manufacture. See, for example, U.S. Pat. No. 5,387,285 to Rivers.

The plug wrap can vary. See, for example, U.S. Pat. No. 4,174,719 to Martin. Typically, the plug wrap is a porous or non-porous paper material. Suitable plug wrap materials are commercially available. Exemplary plug wrap papers ranging in porosity from about 1,100 CORESTA units to about 26,000 CORESTA units are available from Schweitzer-Mauduit International as Porowrap 17-M1, 33-M1, 45-M1, 70-M9, 95-M9, 150-M4, 150-M9, 240M9S, 260-M4 and 260-M4T; and from Miquel-y-Costas as 22HP90 and 22HP150. Non-porous plug wrap materials typically exhibit porosities of less than about 40 CORESTA units, and often less than about 20 CORESTA units. Exemplary non-porous plug wrap papers are available from Olsany Facility (OP Paprina) of the Czech Republic as PW646; Wattenspapier of Austria as FY/33060; Miquel-y-Costas of Spain as 646; and Schweitzer-Mauduit International as MR650 and 180. Plug wrap paper can be coated, particularly on the surface that faces the filter material, with a layer of a film-forming material. Such a coating can be provided using a suitable polymeric film-forming agent (e.g., ethylcellulose, ethylcellulose mixed with calcium carbonate, nitrocellulose, nitrocellulose mixed with calcium carbonate, or a so-called lip release coating composition of the type commonly employed for cigarette manufacture). Alternatively, a plastic film (e.g., a polypropylene film) can be used as a plug wrap material. For example, non-porous polypropylene materials that are available as ZNA-20 and ZNA-25 from Treofan Germany GmbH & Co. KG can be employed as plug wrap materials.

Cigarette filter rods can be used to provide multi-segment filter rods. Such multi-segment filter rods then can be employed for the production of filtered cigarettes possessing multi-segment filter elements. An example of a two-segment filter element is a filter element possessing a first cylindrical segment incorporating activated charcoal particles dispersed within cellulose acetate tow (e.g., a "dalmation" type of filter segment) at one end, and a second cylindrical segment that is produced from a filter rod produced essentially of flavored, plasticized cellulose acetate tow filter material at the other end. The production of multi-segment filter rods can be carried out using the types of rod-forming units that traditionally have been employed to provide multi-segment cigarette filter components. Multi-segment cigarette filter rods can be manufactured using a cigarette filter rod making device available under the brand name Mulfi from Hauni-Werke Korber & Co. KG of Hamburg, Germany. Representative types of filter designs and components, including representative types of segmented cigarette filters, are set forth in U.S. Pat. No. 4,920,990 to Lawrence et al.; U.S. Pat. No. 5,012,829 to Thesing et al.; U.S. Pat. No. 5,025,814 to Raker; U.S. Pat. No. 5,074,320 to Jones et al.; U.S. Pat. No. 5,105,838 to White et al.; U.S. Pat. No. 5,271,419 to Arzonico et al.; U.S. Pat. No. 5,360,023 to Blakley et al.; U.S. Pat. No. 5,396,909 to Gentry et al.; and U.S. Pat. No. 5,718,250 to Banerjee et al; U.S. Patent Application Publication Nos. 2002/0166563 to Jupe et al., 2004/0261807 to Dube et al. and 2005/0066981 to Crooks et al.; PCT Publication No. WO 03/009711 to Kim; PCT Publication No. WO 03/047836 to Xue et al.; and U.S. patent application Ser. No. 11/226,932, filed Sep. 14, 2005, to Coleman III, et al.; which are incorporated herein by reference.

The length of the filter element of each cigarette can vary. Typically, the overall length of a filter element is about 20 mm to about 40 mm, and often about 25 mm to about 35 mm. For a typical dual-segment filter element, the downstream or mouth end filter segment often has a length of about 10 mm to about 20 mm; and the upstream or tobacco rod end filter segment often has a length of about 10 mm to about 20 mm.

Filter elements, or filter segment components of combination filters, typically are provided from filter rods that are manufactured using traditional types of cigarette filter rod making techniques. For example, so-called "six-up" filter rods, "four-up" filter rods and "two-up" filter rods that are of the general format and configuration conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. No. 3,308,600 to Erdmann et al.; U.S. Pat. No. 4,281,670 to Heitmann et al.; U.S. Pat. No. 4,280,187 to Reuland et al.; U.S. Pat. No. 4,850,301 to Greene, Jr. et al.; and U.S. Pat. No. 6,229,115 to Vos et al.; and U.S. Patent Application Publication Nos. 2005/0103355 to Holmes, 2005/1094014 to Read, Jr., and 2006/0169295 to Draghetti, each of which is incorporated herein by reference. The operation of those types of devices will be readily apparent to those skilled in the art of automated cigarette manufacture. Manners and methods for applying adhesives to tipping materials during automated cigarette manufacture will be apparent to those skilled in the art of cigarette design and manufacture. For example, a filtered cigarette can be tipped with a first layer of tipping material in an essentially traditional manner using a Lab MAX tipping device that is available from Hauni-Werke Korber & Co. KG, and that tipped cigarette can be collected and tipped again using that device (e.g., using the device in an essentially traditional manner, or in a suitably modified manner to provide a desired pattern of adhesive application) in order to provide a filtered cigarette possessing two layers of tipping material.

The first layer of tipping material most preferably extends over the entire length of the filter element, and about 2 mm to about 6 mm, often about 3 mm to about 5 mm, and frequently about 4 mm over the length of the adjacent region of the tobacco rod. The second layer of tipping material most preferably extends over the entire length of the filter element, and about 2 mm to about 6 mm, often about 3 mm to about 5 mm, and frequently about 4 mm over the length of the adjacent region of the tobacco rod.

The tipping material that is used for any of the tipping material layers can vary. In certain preferred aspects, the material used to construct both tipping material layers has the characteristics and qualities commonly associated with cigarette tipping materials known in the art. As such, both layers can be constructed of the types of material conventionally used as tipping material in the manufacture of cigarettes. Typical tipping materials are papers exhibiting relatively high opacities. Representative tipping materials have TAPPI opacities of greater than about 81 percent, often in the range of about 84 percent to about 90 percent, and sometimes greater than about 90 percent. Typical tipping materials are printed with inks, typically nitrocellulose based, which can provide for a wide variety of appearances and "lip release" properties. Representative tipping papers materials have basis weights ranging from about 25 $m/m^2$ to about 60 $g/m^2$, often about 30 g/m$^2$ to about 40 g/m$^2$. Representative tipping papers are available as Tervakoski Reference Nos. 3121, 3124, TK 652, TK674, TK675, A360 and A362; and Schweitzer-Mauduit International Reference Nos. GSR270 and GSR265M2. See also, for example, the types of tipping materials, the methods for combining cigarette components using tipping materials, and techniques for wrapping various portions of cigarettes using tipping materials, that are set forth in U.S. patent application Ser. No. 11/377,630, filed Mar. 16, 2006, to Crooks et al.

Adhesives used to secure tipping materials to each other or to other filtered cigarette components can vary. Typical exemplary adhesive formulations that are used for application of tipping material to other cigarette components in commercial filtered cigarette manufacturing operations are water-based emulsions incorporating mixtures of ethylene vinyl acetate copolymers and polyvinylacetate. Representative adhesives that are useful for applying tipping materials to cigarette components are available as Reference Nos. 32-2049 and 32-2124 from National Starch & Adhesives Corp. See also, for example, Skeist, Handbook of Adhesives, 2$^{nd}$ Edition (1977); Schneberger, Adhesive in Manufacturing (1983); Gutcho, Adhesives Technology Developments Since 1979 (1983); Landrock, Adhesives Technology Handbook (1985); and Flick, Handbook of Adhesives Raw Materials, 2$^{nd}$ Edition (1989).

Pressure-sensitive adhesives can be used to provide for adhesion of the outer tipping material to the remaining components of the cigarette (e.g., particularly for manufacture, handling, packaging, shipping, storage and initial use of the cigarette), as well as for providing the ability to readily release (e.g., particularly so that the outer tipping can be readily removed from the cigarette when desired). That is, suitable preferred pressure-sensitive adhesives provide a satisfactory but temporary bond between the outer tipping material and the remaining components of the cigarette, and that adhesive is such that the outer tipping material or a portion thereof can be peeled away, and hence removed from the cigarette, most preferably without leaving to any significant or readily noticeable degree, any adhesive residue on the underlying cigarette components. In addition, suitable preferred pressure-sensitive adhesives, though providing sufficient adhesion so that a double tipped cigarette can be used as desired without adhesive failure (i.e., so as to avoid undesirable premature release of portions of the outer tipping from the cigarette), is most preferably such that purposeful removal of the outer tipping material does not cause any significant or noticeable structural failure to the underlying cigarette components. That is, most preferably, after purposeful removal of the outer tipping material, the resulting cigarette does not possess any significant visual or structural damage resulting from the presence and removal of that outer tipping material. If desired, the outer surface of the underlying first tipping material optionally can be coated with a lacquer, or other suitable coating material, in order to provide a propensity for substantially all the pressure-sensitive adhesive to be removed along with the outer tipping material. Representative pressure-sensitive adhesives are commercially available from a wide variety of sources, such as 3M, Rohm & Haas Company, and Ashland Specialty Chemical Company. See, also, for example, Satas, Handbook of Pressure-Sensitive Adhesive Technology (1982), and Satas, Advances in Pressure Sensitive Adhesive Technology 2 (1995).

Cigarettes can be air diluted. Tipping materials can be pre-perforated, or air diluted on-line using laser perforation techniques. For cigarettes that are air diluted or ventilated, the amount or degree of air dilution or ventilation can vary. Frequently, the amount of air dilution for an air diluted cigarette is greater than about 10 percent, generally is greater than about 20 percent, often is greater than about 30 percent, and sometimes is greater than about 40 percent. Typically, the upper level for air dilution for an air diluted cigarette is less than about 80 percent, and often is less than about 70 percent. As used herein, the term "air dilution" is the ratio (expressed as a percentage) of the volume of air drawn through the air dilution means to the total volume and air and smoke drawn through the cigarette and exiting the extreme mouth end portion of the cigarette. For certain preferred air diluted cigarettes, the cigarettes are air diluted in such a manner that the cigarette exhibits substantially identical levels of air dilution when the second layer is present on the cigarette and when the second layer is removed from the cigarette (e.g., by laser perforating relevant regions of a "two-up" cigarette after that cigarette has the second layer of tipping material applied thereto). Examples of technologies for laser perforation of cigarettes may be found, for example, in U.S. Patent Application Publication No. US 2005/0103355 A1 to Holmes, which is incorporated herein by reference. However, such provisions may not provide any opportunity for customizing or personalizing the cigarette being formed.

As such, FIGS. 1 and 2 illustrate an apparatus for customizing an as-formed cigarette, according to one aspect of the present invention, the cigarette customization apparatus being generally indicated by the numeral 100. In one aspect, the apparatus 100 comprises a feeder unit 204 configured to feed an as-formed cigarette 300 to a register position 400. An imprinting unit 500 is configured to interact with the as-formed cigarette 300 in the register position 400 so as to selectively imprint at least one of an alphanumeric character and a graphical character (collectively indicated as element 600 as shown, for example, in FIG. 4, and otherwise referred to herein as "character 600" for brevity) thereon. The feeder unit 204 and/or the imprinting unit 500 may be controlled by a computer device 700 (as shown, for example, in FIG. 2) though, in some instances, each of the feeder unit 204 and the imprinting unit 500 may be controlled by a separate computer device (i.e., see feeder computer device 710 in FIG. 1). As previously discussed, the as-formed cigarette 300 has a cylindrical rod configuration defining a longitudinal axis, and includes a filter rod portion 325 and a contiguous tobacco rod portion 350.

As shown in FIGS. 1 and 2, the feeder unit 204 is configured to feed an as-formed cigarette 300 to a register position 400. In some instances, the feeder unit 204 may be configured to select the as-formed cigarette 300 from a plurality of as-formed cigarettes 375. The plurality of as-formed cigarettes 375 may be disposed, for example, in a hopper 220 operably engaged with the feeder unit 204. The hopper 220 may be configured as a receptacle portion of the feeder unit 204, into which the plurality of as-formed cigarettes 375 may be manually or automatically fed. In another example, the hopper 220 may comprise a cigarette tray 725 (see, e.g., FIGS. 3A and 3B) configured to collect the plurality of as-formed cigarettes 375 from a separate cigarette making machine (not shown). In such instances, the feeder unit 204 may include a receiver (not shown) configured to receive and interact with the cigarette tray 725 in such a manner that the plurality of as-formed cigarettes 375 are released, either in bulk or sequentially, from the cigarette tray 725 into the feeder device 204 such that an individual as-formed cigarette 300 can be fed to the register position 400. One skilled in the art will appreciate, however, that the plurality of as-formed cigarettes 375 may be provided to the feeder device 204 in many different manners, either online or offline with respect to a cigarette making machine, as required or otherwise desirable.

Since an as-formed cigarette 300 is often better suited to handling in a manner generally perpendicular to the longitudinal axis thereof (i.e., since the cigarette rod is often wrapped along the length thereof by at least one layer of wrapping paper, and since the plurality of as-formed cigarettes 375 are often stacked side-by-side such that the longitudinal axes thereof are all substantially parallel to each other), for example, with respect to the plurality of as-formed cigarettes 375, aspects of a feeder device 204 according to the present invention may be configured to initially separate an individual as-formed cigarette 300 from the plurality of as-formed cigarettes 375 in a direction substantially perpendicularly to the longitudinal axes thereof. Once an individual as-formed cigarette 300 is separated from the plurality of as-formed cigarettes 375, the individual as-formed cigarette 300 can then be fed by the feeder device 204 to the register position 400 in a suitable manner. For example, as shown in FIGS. 1 and 2, the individual as-formed cigarette 300 may be fed longitudinally, along the axis thereof, to the register position 400 by the feeder device 204. In another example, as shown in FIGS. 3A and 3B, the as-formed cigarette, once picked up by the feeder device 204, may be transported to the register position 400 without movement either along or angularly about the longitudinal axis thereof. Though such a feeder device 204 may be configured in many different forms, one example of such a feeder device 204 is disclosed in U.S. Pat. No. 5,510,616 to Seymour et al., which is incorporated herein by reference.

FIGS. 1 and 2 illustrate the example of a feeder device 204 as disclosed by the Seymour '616 patent, for handling a plurality of as-formed cigarettes 375 such as, for example, about 50 in number, deposited in a hopper 220, so as to feed one individual as-formed cigarette 300 at a time to the register position 400. The feeder device 204 may be assembled on a base 200 made from any suitable rigid material, such as aluminum sheet plate, and the hopper 220 is secured to the base 200 in a suitable manner. The feeder device 204 includes a motor 218 which is mounted to an end plate 201 for driving the hopper drum 310 via a suitable connector element, such as a drive shaft 312. The hopper drum 310 includes a plurality of fins 314 extending around the circumference of the drum 310, wherein each fin 314 is spaced apart from the next adjacent fin 314 by a distance sufficient to allow an as-formed cigarette 300 to rest therebetween such that the longitudinal axis of the as-formed cigarette 300 is parallel to the fins 314.

The hopper drum 310 is operably engaged with the feeder device 204 such as, for instance, beneath the hopper 220. The hopper drum 310 can thus be indexed or rotated a predetermined amount (i.e., angular movement of the hopper drum 310), under control of, for example, the computer device 700. As a result, the interaction between the hopper 220 and the hopper drum 310 causes an individual as-formed cigarette 300 to drop between each adjacent pair of fins 314 such that, as the drum 310 continues to rotate when indexed, one of the as-formed cigarettes 300 is deposited into a channel 222 which extends below the hopper drum 310 and across substantially the entire length of the feeder device 204 along an axis parallel to the axis of rotation of the hopper drum 310.

A plunger motor 216 is mounted to end plate 201 of the feeder device 204 and may also be controlled by the computer device 700. When actuated by the computer device 700 (i.e., once an individual as-formed cigarette 300 is deposited by the hopper drum 310 into the channel 222), the motor 216 rotates a threaded shaft 203 operably engaged with and configured to advance a plunger 205 along the channel 222. The plunger 205 advances the as-formed cigarette 300 along the channel 222, along the longitudinal axis thereof, until the as-formed cigarette 300 reaches the register position 400. The travel of the plunger 205 may be determined in many different manners such as, for example, by a suitable optical, contact, or proximity type of limit switch, sensor, or detector 250 (FIG. 1) operably engaged with the feeder device 204 and/or the computer device 700 or 710. In some instances, the register position 400 may be defined outside one of the end plates 207 of the feeder device 204. In the register position 400, at least a portion of the as-formed cigarette 300 is supported by a support 450 in a position approximately parallel to the base 200. The support 450 may be mounted to the end plate 207 of the feeder device 204, or to the base 200, and is aligned with the channel 222. In some instances, the support 450 may define a support channel (not shown) for receiving and supporting the as-formed cigarette 300 while preventing the as-formed cigarette 300 from moving perpendicularly to the longitudinal axis thereof. In operation, the as-formed cigarette 300 travels smoothly along the cigarette channel 222 to the register position 400, with respect to the support 450, when pushed by the plunger 205 via the plunger motor 216, and travels past the end plate 207 of the feeder device 204 to be supported by the support 450 while being imprinted by the imprinting device 500.

As shown in FIGS. 3A and 3B, the hopper drum 310 is operably engaged with the feeder device 204 such as, for instance, adjacent to an exit port of the hopper 220 which, in turn, may be configured to receive the plurality of the as-formed cigarettes from a cigarette tray 725. The hopper drum 310 can thus be indexed or rotated a predetermined amount (i.e., angular movement of the hopper drum 310), under control of, for example, the computer device 700. As a result, the interaction between the hopper 220 and the hopper drum 310 causes an individual as-formed cigarette 300 to be received by the drum 310. The drum 310 then rotates, for example, to a "12 o'clock" position, at which point the as-formed cigarette 300 is disposed in the register position 400 under the imprinting device 500. Once the as-formed cigarette 300 is imprinted by the imprinting device 500, the drum 310 continues to rotate and deposits the imprinted as-formed cigarette 300 on a conveyor device 900, which transports the imprinted as-formed cigarette 300 to an appropriate collection arrangement (not shown).

The imprinting device 500 may be mounted to the feeder device 204 or, in another instance, the imprinting device 500 may be supported by a separate bracket (not shown). In any instance, the imprinting device 500 is appropriately supported with respect to the feeder device 204 to be capable of interacting with the as-formed cigarette 300 in the register position 400. For example, each of the feeder device 204 and the imprinting device 500 may include complementary alignment elements (not shown) capable of operably engaging each other. Once engaged, the alignment elements are configured to align the imprinting unit 500 with the feeder unit 204 such that the imprinting unit 500 interacts with the as-formed cigarette 300 in the register position 400. One skilled in the art will appreciate, however, that different arrangements may also be implemented to allow the imprinting device 500 to appropriately interact with the as-formed cigarette 300 in the register position 400. For example, a pattern-recognition unit (not shown) may be implemented in conjunction with a movable or otherwise adjustable imprinting unit 500, whereby such a pattern-recognition unit first locates the as-formed cigarette 300 and the imprinting site thereon, and then appropriately guides the imprinting unit 500 to interact with the as-formed cigarette 300 in the register position 400.

Once aligned with the as-formed cigarette 300 in the register position 400, the imprinting unit 500 may be further configured to interact with at least one of the filter rod portion 325 and the tobacco rod portion 350 of the as-formed cigarette 300, so as to selectively imprint the at least one of an alphanumeric character and a graphical character 600 thereon as shown, for example, in FIG. 4. The imprinting procedure can be selectively controlled so as to allow for customization and/or personalization of one or more as-formed cigarettes 300. In some instances, the character 600 may be imprinted only on the filter rod portion 325, only on the tobacco rod portion 350, or on both rod portions 325, 350 (i.e., extending over both rod portions 325, 350). Further, the character 600 may be imprinted, for example, angularly (i.e., around the circumference) of the as-formed cigarette 300 or, in other instances, the character 600 may be imprinted along the longitudinal axis of the as-formed cigarette 300 or, in still other instances, spirally along the as-formed cigarette 300. As such, the imprinting unit 500 may include a single laser imprinting unit capable of being controlled by the computer device 700 to provide the angular imprinting and/or the longitudinal imprinting of the character 600 on the as-formed cigarette 300. In other instances, however, the imprinting unit 500 may comprise a plurality of angularly-spaced imprinting elements or laser imprinting units (see, e.g., 500A, 500B, 500C in FIG. 5), wherein each imprinting element or laser imprinting unit is substantially equidistantly-spaced from the longitudinal axis of the as-formed cigarette 300, to substantially correspond with a curvature of the rod of the as-formed cigarette 300. The computer device 700, in communication with and capable of controlling each imprinting element or laser imprinting unit, may also be configured to selectively imprint a portion of the at least one of an alphanumeric character and a graphical character 600 on at least one of the filter rod portion 325 and the tobacco rod portion 350, by selectively implementing (i.e., individually, sequentially, or simultaneously) the plurality of imprinting elements or laser imprinting units. One skilled in the art will also note that the character 600, as a result, may extend along the longitudinal axis of, about the circumference of, or spirally along, the as-formed cigarette 300. Further, in some instances, the support 450 may have a rotation device (not shown) operably engaged therewith. In such instances, the rotation device may be configured to rotate an as-formed cigarette 300, in the register position 400, about the axis of the as-formed cigarette 300 so as to facilitate, for example, printing of the character 600 by a single imprinting element in the longitudinal direction (i.e., by rotating the as-formed cigarette to compensate for the curvature of the rod), printing of the character 600 in an angular manner about the circumference of the rod, or printing the character 600 in a spiral manner around the circumference of the rod as well as longitudinally with respect thereto.

The at least one of an alphanumeric character and a graphical character 600 (or "character 600") may be formed by the imprinting unit 500 in many different selective manners within the scope of aspects of the present invention. For example, the character 600 may comprise, for example, a company logo, alphabetic letters, words, numbers, symbols, graphics, or combinations thereof, to form, for instance, a name, a phone number, an email address, a website address, a short quote, one or more symbols, or combinations thereof (see, e.g., FIG. 4). In some instances, the character 600 may also be combined with various shading, contrasting, underlining, bordering, other special effects, or combinations thereof. In order to imprint the character 600 on the as-formed cigarette 300, the imprinting device 500 is configured to be responsive to the computer device 700 such that the character 600 selected by a user and input into the computer device 700 is selectively transferred to the as-formed cigarette 300 when the as-formed cigarette 300 is in the register position 400. In one instance, the imprinting device 500 may comprise a laser imprinting device such as, for example, a Videojet (3320 or Focus Series) Laser Marking System, a Keyence (ML-G9300 Series) Laser Marking System, a Domino Laser Head Model No. S200 Red, or other suitable model and/or series of imprinting device, operably engaged with a Model No. DPX 1000 vacuum system. The computer device 700 operably engaged therewith may comprise, for example, a Laser Controller PC executing Dynamark II operating software, and communicating with the imprinting device 500 via an appropriate interface.

In basic operation, the plurality of as-formed cigarettes 375 is first loaded into the hopper 220 by manual loading or via a cigarette tray disposed so as to feed the plurality of as-formed cigarettes 375 into the hopper 220. At the Laser Controller PC, the desired message (i.e., character string) is entered via the Dynamark II operating software, wherein the message may be represented by, for example, a text message and/or a monochrome bitmap image. The bitmap image may be generated on another computer device and then imported into the operating software, or the bitmap image may be created via the Dynamark II operating software itself. The message may then be aligned, formatted, and appropriately sized with respect to the portion of the as-formed cigarette 300 on which the message is to be imprinted. More particularly, the operating parameters for the Laser Head are entered via the Dynamark II operating software, controlling such parameters as Mark Speed in bits per millisecond and Laser-On-$CO_2$ to vary the intensity of the laser burn on the as-formed cigarette 300 (which also varies the "depth" of the laser burn with respect to the paper wrapping the as-formed cigarette 300). Such parameters may be adjusted, for instance, depending on whether the imprinting of the character 600 is directed to the paper wrapping the filter rod portion 325 or to the paper wrapping the tobacco rod portion 350.

Once the message and operating parameters have been input into the Laser Controller PC, the parameters of the as-formed cigarette are entered via the Operator Interface executed on the computer device 700, wherein such parameters vary depending on whether the imprinting of the character 600 is directed to the paper wrapping the filter rod portion 325 or to the paper wrapping the tobacco rod portion 350, and include, for example, the length of the tobacco rod portion 350 and the total length of the as-formed cigarette 300 (i.e., in millimeters). The Operator Interface controls, for example, the operation of the feeder device 204, previously discussed, for receiving an as-formed cigarette 300 from the hopper 220 and then feeding that as-formed cigarette 300 to the register position 400 for interaction with the Laser Head.

In operation, the channel 222, sometimes in cooperation with the support 450, maintains the as-formed cigarette aligned in the register position 400 while being imprinted by the imprinting device 500. As shown in FIG. 6, after a first as-formed cigarette 300A is imprinted, the computer device 700, via the executed software, directs the feeder device 204 to feed a second as-formed cigarette 300B to the register position 400. In doing so, the second as-formed cigarette 300B advanced by the plunger 205 displaces the first as-formed cigarette 300A from the support 450, while the second-as-formed cigarette 300B is placed in the register position 400 for imprinting thereon by the imprinting device 500. The displaced imprinted as-formed cigarette 300A may be collected, for example, by a collector device 800 operably engaged with or otherwise disposed adjacent to the support 450. This successive displacement process may be selectively continued for any number of cigarettes from the hopper 220 or, in other instances, may be allowed to continue until the plurality of as-formed cigarettes 375 in the hopper 220 is depleted. In such instances, once the plurality of cigarettes 375 is depleted from either the hopper 220 or any implemented cigarette tray, operation of the feeder device 204 and the imprinting device 500 is halted or placed in a stand-by mode, pending deposition of additional cigarettes in the hopper 220. In some instances, the apparatus 100 may include a counting device (not shown) configured to count, and provide an indicia of the count, of the total number of as-formed cigarettes 300 imprinted by the imprinting device 500.

In some configurations, the apparatus 100 may be capable of imprinting, for example, about 20 cigarettes per minute. However, one skilled in the art will appreciate that the apparatus 100 may be readily modified to provide faster or slower processing speeds by, for example, changing the pitch of the threaded shaft 203. In this regard, the character 600 imprinted on the as-formed cigarette 300 may be affected by various parameters associated with the operation of the apparatus 100. For example, print resolution may be controlled by:

a) Character width and height: For a single line of print, a character dimension of about 3 mm wide and about 4 mm high may be required. For two lines of print, a character dimension of about 1.5 mm wide and about 2.5 mm high may be required. For three lines of print, a character dimension of about 1.5 mm wide and about 2.0 mm high may be required.

b) Character font and weight: Representative fonts include 3-LS Arial, 2-LS Arial, Comic Sans MS, Times New Roman, or any other suitable font.

c) Character weight may be controlled by the use of the bold print selection. Adjustments may also be made in the laser power and laser beam duration settings, and such parameters may also affect the appearance of the printed character.

The number of characters 600 that may be included on each line of message may be controlled, for example, by:

a) The dimension of the portion of the as-formed cigarette 300 being imprinted. For instance, if the filter rod portion 325 is to be customized, the length of the filter tipping paper may be the limiting factor. If the tobacco rod portion 350 is to be customized, the length of the tobacco rod portion 350 may be the limiting factor.

b) The particular font and character weight used for the customization. As the values of such parameters increase, the total number of characters 600 capable of being used decreases.

In some instances, the customized message may include up to 3 lines on the as-formed cigarette 300 (see, e.g., FIG. 4), if the as-formed cigarette 300 is stationarily maintained in register position 400 during the imprinting process and the message extends along the longitudinal axis of the as-formed cigarette 300. However, if the feeder device 204/support 450 is configured to rotate the as-formed cigarette 300 during imprinting process (while imprinting along the longitudinal axis of the as-formed cigarette 300) and/or if the imprinting device 500 is configured to imprint around the circumference of the as-formed cigarette 300, or spirally along the as-formed cigarette 300, more lines may be imprinted. In any instance, one aspect involves determining appropriate imprinting parameters such that the character is of sufficient clarity so as to not appear "washed out" or faded after the imprinting process.

As previously discussed, the color of the wrapping materials for the tobacco rod (e.g., cigarettes marketed under the trade name "More" by R. J. Reynolds Tobacco Company possess cigarette rod wrapping papers exhibiting a brown color), and tipping materials used to attach the tobacco rod to the filter element (see, e.g., FIG. 4 wherein tipping materials have been printed or otherwise formed so as to possess a "cork" appearance, a white-colored appearance, a cinnamon-colored appearance, and/or to possess at least one circumscribing ring), may be widely varied. Examples of procedures for producing a printed cigarette wrapping paper for a cigarette making process may be found in U.S. Patent Application Publication No. US 2005/0076929 A1 to Fitzgerald et al., which is incorporated herein by reference. When such wrapping or tipping materials are imprinted by an imprinting device 500 according to aspects of the present invention, the laser imprinting device is configured to partially "burn" the wrapping material, or a layer of the wrapping material (if the wrapping material includes multiple layers), so as to imprint the selected character 600 to provide a suitable contrast with respect to the wrapping material, but without burning therethrough. The contrast provided by the interaction between the laser imprinting device and the wrapping material allows the character to be visible/legible and facilitates customization/personalization of the as-formed cigarette 300. For example, interaction of the laser imprinting device with a white wrapping material may produce a brown-colored contrasting character 600, while interaction with a "brown" wrapping material may produce a white-colored contrasting character. In some instances, the operational parameters of the laser imprinting device may also be varied, in cooperation with the wrapping material, to provide a different contrasting color of the imprinted character 600.

According to one aspect, implementing an imprinting device 500 as previously discussed herein, it was found that variations in particular parameters could cause the laser imprinting device 500 to either "burn" too lightly, such that an unsatisfactory character 600 is provided, or to "burn" too heavily, so as to burn through the wrapping material. Parameters such as "mark-speed" and "laser on $CO_2$" were found to be important in this regard. In one embodiment, the parameters of the laser imprinting device 500 are selected so as to provide a balance, for example, between the depth/extent of the "burn" provided by the laser imprinting device, versus the contrast achieved with respect to the imprinted character 600, but without changing the performance characteristics of the as-formed cigarette 300. That is, for instance, the laser imprinting device is configured to provide a sufficient "burn" for producing the visible/legible imprinted character 600, but without providing any further air dilution with respect to the as-formed cigarette 300, other than the air dilution purposedly provided for the particular as-formed cigarette 300 to obtain the desired performance characteristics thereof. The values of the parameters shown in the following table seemed to provide, for a particular set of test conditions, an acceptable balance between the "appearance" of the character 600 and the depth of the "burn" provided by the laser imprinting device 500. One skilled in the art will appreciate, however, that such parameters may change considerably depending on particular conditions encountered in any given cigarette customization process.

| Parameter | Tobacco rod portion paper | Filter rod portion paper |
|---|---|---|
| step-period μs | 30 | 30 |
| jump-delay μs | 90 | 90 |
| mark-delay μs | 500 | 500 |
| polygon-delay μs | 30 | 30 |
| laser-off-delay μs | 120 | 120 |
| laser-on-delay μs | 10 | 10 |
| laser on $CO_2$ μs | 225 | 300 |
| jump-speed bit/ms | 20000 | 20000 |
| mark-speed bit/ms | 20000 | 2000 |
| max. vector-length mm | .38 | .38 |

One skilled in the art will further appreciate that the customization/personalization process discussed herein may occur in a number of different manners. For example, such customization/personalization may occur at the cigarette making plant, factory, or laboratory. That is, customized/personalized cigarettes could be created onsite at the factory (i.e., cigarettes produced by a high speed cigarette making machine are stored in a cigarette tray, wherein the tray is then engaged with the apparatus 100, which processes (imprints) the cigarettes and then directs the imprinted cigarettes to a collection device for collection and re-traying for later packaging) for promotions, special offers, and/or customized sales. In other instances, a portable apparatus 100 may allow such customization/personalization to be implemented in an aftermarket setting outside the factory or lab environment. For example, a portable apparatus 100 could be implemented at "brand" events (i.e., previously-packaged cigarettes could be provided by a customer or retailer, wherein the cigarettes are unpackaged and loaded into the hopper of the apparatus 100, and whereby the apparatus 100 is configured to process (imprint) the cigarettes and direct the imprinted cigarettes to a collection device for collection and repackaging) and/or at cigarette stores (i.e., a retailer produces customized/personalized cigarettes at the request of a customer, wherein the cigarettes are unpackaged and loaded into the hopper of the apparatus 100, and whereby the apparatus 100 is configured to process (imprint) the cigarettes and direct the imprinted cigarettes to a collection device for collection and repackaging) to instantly customize/personalize cigarettes for adult smokers. Such customization/personalization could be accomplished selectively (i.e., a chosen number of cigarettes), in bulk (i.e., a batch of cigarettes), or on a per pack or a per carton basis. In other instances, the apparatus 100 could be configured for selective operation by a consumer at a point of sale (i.e., the apparatus 100 could be provided as a "kiosk" where the purchaser of cigarettes could choose to customize the cigarettes of a purchased pack on a self-serve basis).

In some instances, cigarettes are manufactured such that substantially all of the cigarettes within a lot are of consistent quality. It is highly preferred that cigarettes of a particular lot are comparable to one another in terms of appearance, size, shape, component materials, weight, tobacco filler particle size distribution, tobacco rod firmness, smoking properties, puff count, smoke yield, and the like. Preferred cigarettes within a lot each incorporate tobacco filler from a comparable source, and the weight of tobacco filler within each cigarette differs by not more that 10 percent, more preferably by not more than about 5 percent, and most preferably by not more than about 2.5 percent. In a preferred cigarette-making operation, an operator never touches the cigarette directly with his/her hands, so as to prevent moisture, skin oils, or other materials on the operator's hands from soiling or marring the aesthetic appearance of the cigarette.

However, in other instances, a cigarette may be manufactured, for example, by providing a selection of tobacco appropriate for use in cigarettes; allowing a customer to select a tobacco or blend of several tobaccos; assembling the selected tobacco or blend of tobaccos substantially simultaneously into a plurality of cigarettes having substantially consistent quality (including at least consistent density and tobacco mass); and providing at least some of the plurality of cigarettes to the customer. Such a method may also include packaging the plurality of cigarettes. Alternatively, the customer may be allowed to select a plurality of tobaccos or a plurality of tobacco blends, wherein assembling a plurality of the cigarettes may include one or more of the plurality of cigarettes having a different tobacco and/or blend than other(s) in the plurality of cigarettes. Further, in another alternative, the selected tobacco or blend of tobaccos may be provided in the form of tobacco cartridges that may be assembled into cigarettes using, for example, a cigarette making apparatus. Such cigarette making apparatuses using such methods are described, for example, in U.S. Patent Application Publication Nos. US 2006/0272654 A1 to Barnes et al., US 2006/0272655 A1 to Thomas et al., and US 2007/0006888 A1 to Hicks et al., which are each incorporated herein by reference.

In addition, such a cigarette making device may be incorporated within a tobacco specialty retail shop or store. That is, at least one such device may be on prominent display within the premises of a retail establishment specializing in high quality or premium tobacco products. Such a shop or store may have a name that corresponds to the brand name of tobacco products available for sale within that shop or store. For example, such a cigarette-making device can be employed to manufacture cigarettes for commercial sale in a tobacco retail outlet such as the establishment operating as Marshall McGearty Tobacco Lounge at 1553 N. Milwaukee Avenue, Chicago, Ill. The shop or store preferably includes an inviting atmosphere, comfortable lounge areas or appropriate places to sit and enjoy the smoking of tobacco products, a high quality air handling or air conditioning system, and locations to purchase tobacco products. A customer within such a shop or store can talk with a tobacconist about the cigarettes that are manufactured in that retail establishment. The packaging, filter materials, cigarette paper materials, tobacco components (including the selection of tobacco types and grade, tobacco blends, and casing and top dressing components) can be high quality in terms of sensory properties and appearance. Locating a cigarette making device within such a shop or store allows the customer within such an establishment to experience the manufacture of cigarettes, and enjoy cigarettes that are freshly made in his/her presence. For example, that customer can smell the aroma of different tobaccos within the store, and can view the manufacture of cigarettes expressly for him/her. As one example, a customer may choose between tobacco blends such as those incorporated into Marshall McGearty brand styles identified as The Standard, Karmelita, Oriental Rose, Malawi Kings, Cutlass, Samsun Straights, Virginia, Four Corners, The Empress, The Earl, North Star, Aegean, and Muse. The selected blend(s) may then be manufactured into cigarettes by Marshall McGearty Tobacco Artisans using the cigarette making apparatus. In this environment, using multi-sensory inputs (e.g., sight, smell), the customer can make an informed decision on his/her selection of different tobaccos and/or tobacco blends to be loaded into a cigarette making apparatus to manufacture cigarettes in his/her presence. Thus, embodiments of a cigarette customization apparatus 100 according to the present invention may also be utilized in such a retail setting that provides a customer with an aesthetic experience and an individually selected product.

In any instance, as-formed cigarettes imprinted according to embodiments of the present invention, aside from being re-packaged as detailed, for example, in U.S. Patent Application Publication Nos. US 2006/0272654 A1 to Barnes et al., US 2006/0272655 A1 to Thomas et al., and US 2007/0006888 A1 to Hicks et al., previously incorporated herein by reference, may also be randomly distributed, or be packaged with non-imprinted as-formed cigarettes. For example, the imprinted as-formed cigarettes could be combined with other as-formed cigarettes, whether imprinted or not, using a method and apparatus as detailed, for instance, in International Publication No. WO2006/016154 A2 to Ancona et al. In such a manner, the imprinted cigarettes may be used, for example, for purposes of a contest (i.e., the holder of a pack of cigarettes having an imprinted cigarette therein may be the winner of a prize), or in any other manner where the presence of an imprinted cigarette may distinguish the holder thereof.

Many modifications and other aspects of the invention will come to mind to one skilled in the art to which this invention pertains having the benefit of the teachings presented in the foregoing description; and it will be apparent to those skilled in the art that variations and modifications of the present invention can be made without departing from the scope or spirit of the invention. Therefore, it is to be understood that the invention is not to be limited to the specific aspects disclosed and that modifications and other aspects are intended to be included within the scope of the appended claims. Although specific terms are employed herein, they are used in a generic and descriptive sense only and not for purposes of limitation.

That which is claimed:

1. An apparatus for customizing an as-formed cigarette, the as-formed cigarette having a cylindrical rod configuration defining a longitudinal axis, and including a filter rod portion and a contiguous tobacco rod portion having a paper wrapping material, the apparatus comprising:

a hopper configured to receive a plurality of as-formed cigarettes such that the longitudinal axes of the as-formed cigarettes are disposed in parallel;

a hopper drum rotatable about a longitudinal axis associated therewith, the hopper drum being operably engaged with the hopper such that the longitudinal axis thereof is disposed in parallel with the longitudinal axes of the as-formed cigarettes, the hopper drum being configured to receive a single as-formed cigarette at a time from the as-formed cigarettes in the hopper at a first position of the hopper drum and to rotatably transport the single as-formed cigarette, absent axial movement thereof along the longitudinal axis, to a register position of the hopper drum, the hopper drum being further configured to pause at the register position such that the hopper drum and the single as-formed cigarette are maintained in a stationary position during an imprinting process with respect to the single as-formed cigarette, implemented at the register position of the hopper drum; and a laser imprinting unit configured to interact with one of the filter rod portion and the paper wrapping material of the stationary single as-formed cigarette in the register position when rotation of the hopper drum is paused so as to selectively imprint at least one of an alphanumeric character and a graphical character thereon.

2. An apparatus according to claim 1 further comprising a rotational device configured to rotate the as-formed cigarette, in the register position, about the longitudinal axis thereof.

3. An apparatus according to claim 1 further comprising a collector device operably engaged with the hopper drum and configured to collect the as-formed cigarettes after imprinting thereof by the imprinting device.

4. An apparatus according to claim 1 wherein the laser imprinting unit is further configured to selectively imprint the at least one of an alphanumeric character and a graphical character on at least one of the filter rod portion and the tobacco rod portion along the longitudinal axis of the as-formed cigarette.

5. An apparatus according to claim 1 wherein the laser imprinting unit further comprises a plurality of angularly-spaced imprinting elements, each imprinting element being equidistantly-spaced from the longitudinal axis of the as-formed cigarette, so as to substantially correspond with a curvature of the as-formed cigarette, and being configured to selectively imprint a portion of the at least one of an alphanumeric character and a graphical character on at least one of the filter rod portion and the tobacco rod portion along the longitudinal axis of the as-formed cigarette.

6. An apparatus according to claim 1 wherein the hopper drum and the laser imprinting unit further include complementary alignment elements capable of being operably engaged, the operably engaged alignment elements being configured to align the laser imprinting unit with the hopper drum such that the laser imprinting unit interacts with the as-formed cigarette in the register position.

7. A method of customizing an as-formed cigarette, the as-formed cigarette having a cylindrical rod configuration defining a longitudinal axis, and including a filter rod portion and a contiguous tobacco rod portion having a paper wrapping material, the method comprising:

separating a single as-formed cigarette at a time, from a plurality of as-formed cigarettes disposed in a hopper such that the longitudinal axes of the as-formed cigarettes are disposed in parallel, with a hopper drum rotatable about a longitudinal axis associated therewith, the hopper drum being operably engaged with the hopper such that the longitudinal axis thereof is disposed in parallel with the longitudinal axes of the as-formed cigarettes, by receiving the single as-formed cigarette at a first position of the hopper drum;

rotating the hopper drum about the longitudinal axis thereof, from the first position to a register position of the hopper drum so as to rotatably transport the single as-formed cigarette, absent axial movement thereof along the longitudinal axis, to the register position;

pausing rotation of the hopper drum at the register position such that the hopper drum and the single as-formed cigarette are maintained in a stationary position;

selectively imprinting at least one of an alphanumeric character and a graphical character on one of the filter rod portion and the paper wrapping material of the single as-formed cigarette using a laser imprinting unit, when the hopper drum is paused in the register position; and the hopper drum and the single as-formed cigarette are disposed in a stationary position.

8. A method according to claim 7 further comprising rotating the as-formed cigarette, in the register position, about the longitudinal axis thereof.

9. A method according to claim 7 further comprising collecting the as-formed cigarettes, after imprinting thereof by the imprinting device, with a collector device operably engaged with the hopper drum.

10. A method according to claim 7 wherein selectively imprinting at least one of the alphanumeric character and the graphical character further comprises selectively imprinting at least one of the alphanumeric character and the graphical character on at least one of the filter rod portion and the tobacco rod portion of the as-formed cigarette, along the longitudinal axis of the as-formed cigarette.

11. A method according to claim 7 wherein the laser imprinting unit further comprises a plurality of angularly-spaced imprinting elements, with each imprinting element being equidistantly-spaced from the longitudinal axis of the as-formed cigarette, so as to substantially correspond with a curvature of the as-formed cigarette, and wherein selectively imprinting at least one of the alphanumeric character and the graphical character further comprises selectively imprinting a portion of the at least one of the alphanumeric character and the graphical character on at least one of the filter rod portion and the tobacco rod portion along the longitudinal axis of the as-formed cigarette.

12. A method according to claim 7 wherein the hopper drum and the laser imprinting unit further include complementary alignment elements capable of being operably engaged, and the method further comprises operably engaging the alignment elements so as to align the laser imprinting unit with the hopper drum such that the laser imprinting unit interacts with the as-formed cigarette in the register position.

* * * * *